US009375610B1

(12) United States Patent
Bilge

(10) Patent No.: US 9,375,610 B1
(45) Date of Patent: Jun. 28, 2016

(54) SWIM FIN

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 2 days.

(21) Appl. No.: 14/571,745

(22) Filed: Dec. 16, 2014

(51) Int. Cl.
*A63B 31/08* (2006.01)
*A63B 31/11* (2006.01)

(52) U.S. Cl.
CPC ..... *A63B 31/11* (2013.01)

(58) Field of Classification Search
CPC ..... A63B 31/11
USPC ..... 441/64
See application file for complete search history.

(56) References Cited

U.S. PATENT DOCUMENTS

| | | | | | |
|---|---|---|---|---|---|
| 3,521,312 | A * | 7/1970 | Ganev | A63B 31/11 | 441/64 |
| 4,627,820 | A * | 12/1986 | Penebre | A63B 31/11 | 441/64 |
| 5,330,377 | A | 7/1994 | Kernek | | |
| 5,417,599 | A * | 5/1995 | Evans | A63B 31/11 | 441/64 |
| 5,536,190 | A | 7/1996 | Althen | | |
| 2007/0077831 | A1 * | 4/2007 | Kuo | A63B 31/11 | 441/64 |

* cited by examiner

*Primary Examiner* — Stephen Avila
(74) *Attorney, Agent, or Firm* — Richard M. Goldberg

(57) ABSTRACT

A swim fin includes a blade, a retaining arrangement on the blade for removably securing a person's foot to the blade, and at least one propulsion increasing shell mounted on an upper surface of the blade, each shell having a hollowed out portion to increase a surface area of propulsion of the swim fin.

17 Claims, 7 Drawing Sheets

SWIM FIN

BACKGROUND OF THE INVENTION

The present invention relates generally to swim fins, and more particularly, is directed to a swim fin that increases the surface area for propulsion.

It is well known to use swim fins or flippers on a person's feet when swimming for providing added propulsion to the swimmer. Such swim fins include a blade or flipper on which is provided an arcuate encasing wall extending upwardly from the blade at one end thereof so as to define a foot receiving recess between the blade and arcuate encasing wall. The recess has a closed toe portion at one end and an opening at the opposite end through which a person can insert his or her foot into the foot receiving recess. A strap is provided at the open end to maintain the person's foot in the foot receiving recess. The swim fin is preferably made of a material such as a molded rubber having a suitable hardness to impart durability, while at the same time, being flexible and resilient, thereby allowing the swim fin to flex a little during a swimming stroke.

However, the problem with conventional swim fins is that the surface area for propulsion is generally limited to that of the flat blade portion.

It is known to increase the surface area of a swim fin, for example, by providing multiple, parallel, spaced apart layers, as disclosed in U.S. Pat. No. 5,330,377. However, such a construction greatly increases the size of the swim fin, making it unwieldy to use, and making it nearly impossible to walk on dry land.

It is also known to provide pivoting hydrofoil blades in a swim fin, as disclosed in U.S. Pat. No. 5,536,190. However, these do not increase the surface area for propulsion.

SUMMARY OF THE INVENTION

Accordingly, it is an object of the present invention to provide a swim fin that overcomes the aforementioned problems.

It is another object of the present invention to provide a swim fin that increases the surface area for propulsion.

It is still another object of the present invention to provide a swim fin that also enables walking by a person on dry land.

In accordance with an aspect of the present invention, a swim fin includes a blade, a retaining arrangement on the blade for removably securing a person's foot to the blade, and at least one propulsion increasing curved wall mounted to at least one surface of the blade, each propulsion increasing curved wall having a surface which increases a propulsion surface area of the swim fin for providing increased propulsion.

In one embodiment, the at least one propulsion increasing curved wall includes at least one propulsion increasing shell. Each shell includes a shell membrane extending outwardly from the at least one surface of the blade, a front wall formed inwardly of a forward edge of each shell to prevent entry of water into the shell membrane behind the front wall, and a cowl that extends outwardly from the front wall of the shell membrane, wherein an undersurface of the shell membrane in front of the front wall and an undersurface of the cowl function to provide an additional propulsion force during a swim stroke. The cowl forms a continuation of a front edge of the shell membrane. Preferably, each propulsion increasing shell tapers in a widthwise direction from a front end to a rear end thereof.

In another embodiment, the at least one propulsion increasing curved wall includes at least one propulsion increasing blade.

The retaining arrangement includes an elongated foot encasing membrane mounted on the blade and defining a foot receiving recess between the blade and the foot encasing membrane, and an elastic strap connected with the foot encasing membrane for engaging a heel of a person's foot that is positioned in the foot receiving recess to prevent escape of the person's foot therefrom during a swimming operation.

The at least one propulsion increasing curved wall is mounted to at least one of the following: an upper surface of the blade, a lower surface of the blade, a side edge of the blade, a front edge of the blade and an upper surface of the retaining arrangement.

The blade, the retaining arrangement and the at least one propulsion increasing curved wall are formed a material which is flexible and resilient. Preferably, the material is rubber.

In one embodiment, each propulsion increasing curved wall is integrally formed in one-piece with the blade.

In another embodiment, each propulsion increasing curved wall is removably mounted on the blade. In such case, each blade includes at least one groove, and each propulsion increasing curved wall includes a tongue that is removably mounted in at least one respective groove. In the case where the at least one propulsion increasing curved wall includes at least one propulsion increasing shell, each propulsion increasing shell includes tongues at lower edges thereof, for removable insertion in respective grooves.

In another embodiment, the at least one propulsion increasing curved wall includes at least one propulsion increasing shell, each blade includes at least one opening, and each propulsion increasing shell is pivotally mounted to the blade in a respective opening. In such case, each shell includes an upper shell membrane extending outwardly relative to an upper surface of the blade, a lower shell membrane extending outwardly relative to a lower surface of the blade, a front wall formed inwardly of a forward edge of each shell membrane and interconnecting the upper shell membrane with the lower shell membrane to prevent entry of water into the shell behind the front wall, and wherein an inner surface of the upper shell membrane in front of the front wall and an inner surface of the lower shell membrane in front of the front wall function to provide an additional propulsion force during a swim stroke. There is a pivot connected to the blade and extending in each opening near a rear edge thereof and through a rear portion of the shell membrane, and a pivot limiter for limiting a pivoting range of each propulsion increasing shell. The pivot limiter includes an arcuate slot near a forward end of each shell, and a limiting pin extending across each opening near a midpoint thereof, and through the shell.

In a modification thereof, each arcuate slot includes a plurality of discrete pockets for retaining the limiting pin therein to hold the respective propulsion increasing shell at a desired position.

The above and other features of the invention will become readily apparent from the following detailed description thereof which is to be read in connection with the accompanying drawings.

DETAILED DESCRIPTION

Figure 1:
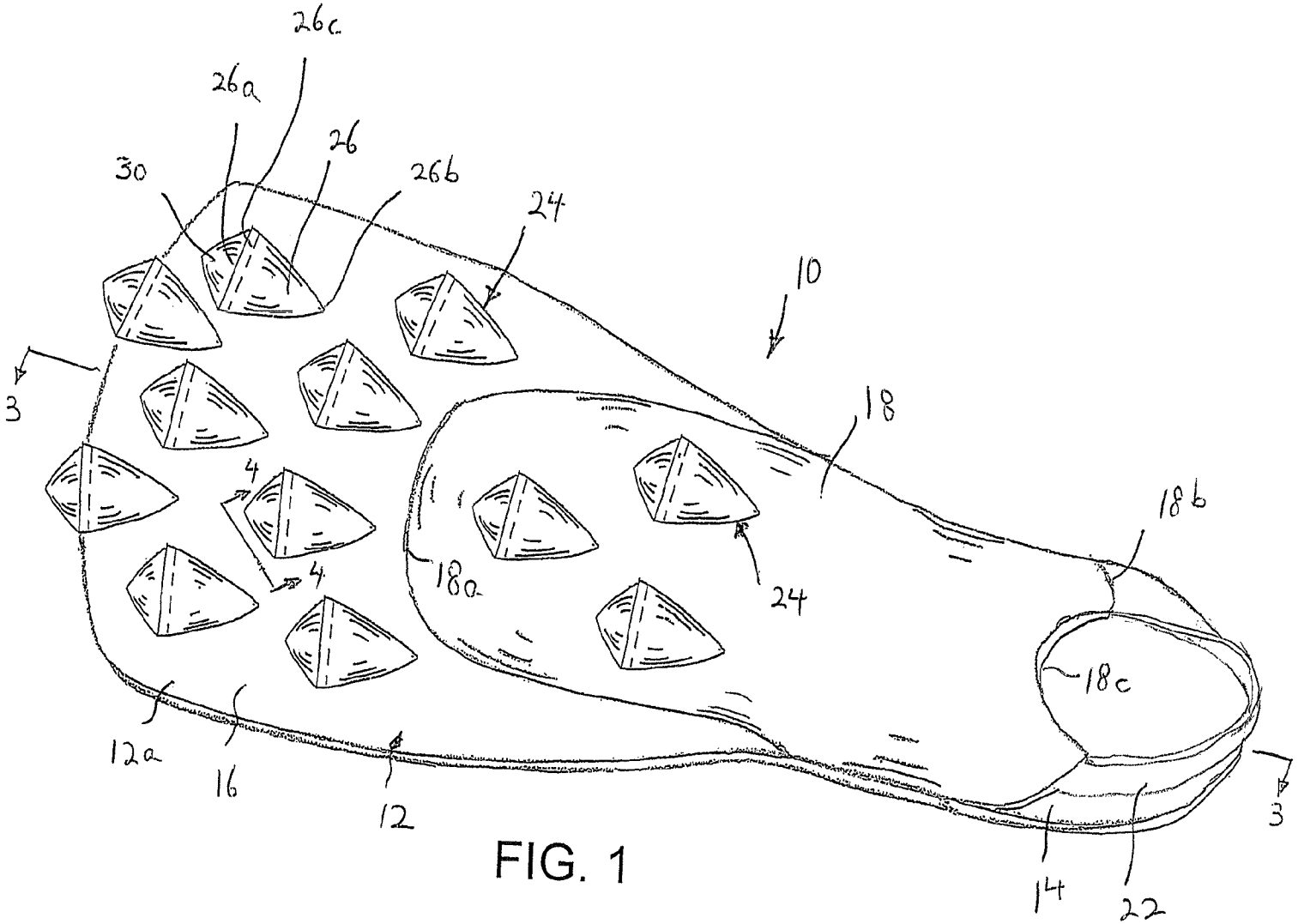
FIG. 1 is a top perspective view of a swim fin according to a first embodiment of the present invention.

Referring to the drawings in detail, and initially to FIGS. 1-4 thereof, a swim fin 10 according to a first embodiment of the present invention, includes a generally flat blade 12 having an upper surface 12*a* and a lower surface 12*b*. Flat blade 12 includes a foot receiving section 14 for supporting a person's foot thereon, and a diverging propulsion section 16 that is integral with and extends forwardly from foot receiving section 14. Propulsion section 16 has a greater widthwise dimension than foot receiving section 14 in order to increase the surface area, and thereby, the propulsion during a swimming stroke, as is well known. An elongated foot encasing membrane 18 extends upwardly from the upper surface 12*a* of foot receiving section 14 in a generally arcuate manner in order to define a foot receiving recess 20 between foot receiving section 14 and foot encasing membrane 18. Foot encasing membrane 18 is connected to foot receiving section 14 at its forward end 18*a* so as to close off foot receiving recess 20 thereat, but is raised above and not connected with foot receiving section 14 at its rear edge 18*b* in order to permit entry and exit of a foot from foot receiving recess 20. In addition, rear edge 18*b* can be formed with an arcuate indent 18*c* in order to better receive the person's foot and to provide comfort to the foot when positioned in foot receiving recess 20.

An elastic strap 22 is connected to opposite sides of foot encasing membrane 18 in order to engage the heel of the person's foot and prevent escape of the foot from foot receiving recess 20 during a swimming stroke.

The above structure is well known.

In accordance with the present invention, a plurality of propulsion increasing shells 24 are formed on the upper surface 12*a* of propulsion section 16 and/or the upper surface of foot encasing membrane 18. Each propulsion increasing shell 24 includes an arcuate shell membrane 26 that extends upwardly from the respective upper surface of propulsion section 16 and/or foot encasing membrane 18 in an orientation in which shell membrane 26 tapers in width from a forward edge 26*a* to a rear end 26*b* thereof.

The majority of shell membrane 26, starting from the rear end 26*b* thereof is filled by a solid fill 28 of the same material as shell membrane 26 and swim fin 10, that is, solid fill 28 fills that portion of shell membrane 26 that extends from rear end 26*b* to a position indicated by dashed lines 26*c* in FIG. 1. As a result, a front wall 28*a* is formed near the open forward edge 26*a* of propulsion increasing shells 24, spaced slightly rearwardly of forward edge 26*a*. This prevents too much water from entering propulsion increasing shells 24 and causing a drag on the swim fin. Alternatively, since solid fill need only prevent water from entering the entire shell membrane 26, solid fill 28 can be formed merely by a thin front wall 28*a*, with the portion of shell membrane 26 behind front wall 28*a* being hollow to reduce the weight and materials used. In such case, air in a hollow sealed air pocket in shell 24 behind front wall 28*a* aids in the buoyancy of the swim fin. Still further, front wall 28*a* and solid fill 28 can be eliminated entirely so that the entire underside of shell membrane 26 is hollow.

Figure 2:
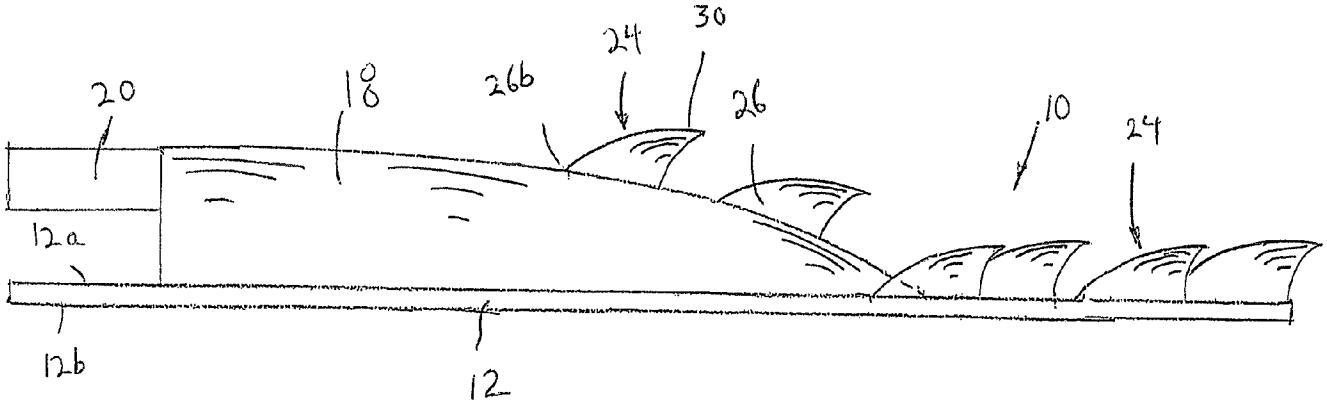
FIG. 2 is a side elevational view of the swim fin of FIG. 1.
Figure 3:
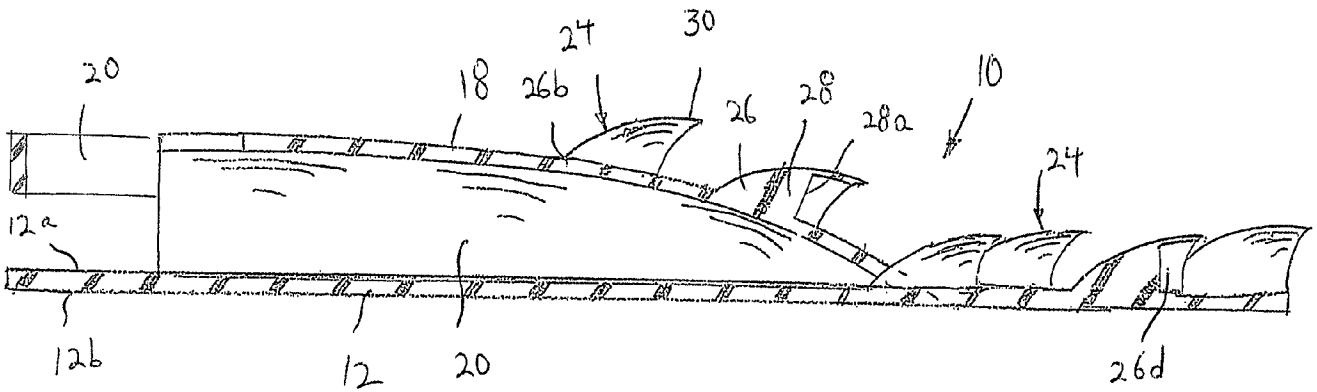
FIG. 3 is a cross-sectional view of the swim fin of FIG. 1, taken along line 3-3 of FIG. 1.
Figure 4:
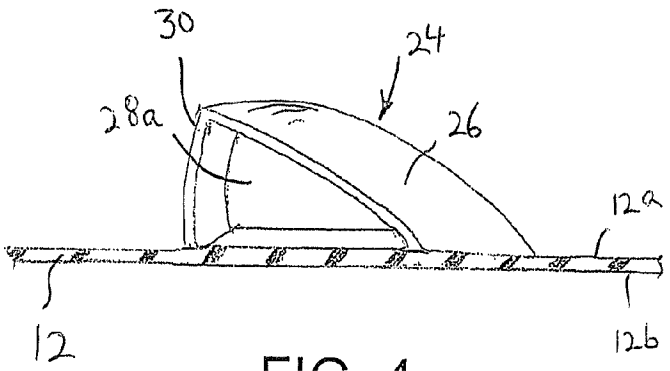
FIG. 4 is a cross-sectional view of the swim fin of FIG. 1, taken along line 4-4 of FIG. 1.

A cowl or hood membrane 30 extends forwardly from the upper end of forward edge 26*a*, with cowl 30 tapering in width toward the front end thereof. Preferably, the forward edge 26*a* of each arcuate shell membrane 26 is curved upwardly and forwardly, so that cowl 30 merely forms a continuation thereof, as best shown in FIGS. 2 and 3. Further, like the scales of a fish, shells 24 aid in streaming water flow and aid the user in orienting the fin and changing the direction of the fin to a desired direction.

As a result of this construction, when a person's foot moves with an upward stroke in the water, in addition to the upwardly facing lower surface 12*b* of blade 12 serving to provide propulsion, water is also displaced by the upwardly facing underside of cowl 30 as well as the underside of upwardly facing propulsion increasing shell 24 defined by a hollow portion 26*d* of propulsion increasing shell 24 situated in front of solid wall 28*a*, that is, between forward edge 26*a* and dashed line 26*c*.

This functions to increase the surface area of propulsion, while not substantially increasing the drag on swim fin 10.

During a reverse stroke action, that is, when the foot is moving downwardly, the downwardly facing upper surface 12*a* of blade 12 serves to provide the propulsion. Also, the outer surfaces of propulsion increasing shells 24 along with the cowls 30 thereof function to provide propulsion.

The entire swim fin 10, along with blade 12, elastic strap 22, propulsion increasing shells 24 and cowls 30 is preferably made as a one-piece, unitary structure of a material such as a molded rubber having a suitable hardness to impart durability, while at the same time, being flexible and resilient, thereby allowing the swim fin to flex a little during a swimming stroke.

In addition, although not required by the present invention, it will be appreciated that propulsion increasing shells 24 are offset or staggered from each other. This ensures that each propulsion increasing shell 24 will not be adversely affected by diversion of water caused by a propulsion increasing shell 24 in front thereof. However, it is possible that propulsion increasing shells 24 can be arranged inline with each other, or in any other suitable configuration.

Further, as shown in FIGS. 1-3, propulsion increasing shells 24 are also preferably provided at the front edge of blade 12 to further increase the surface area for propulsion.

It is noted that the shape, dimensions and arrangement of propulsion increasing shells 24 are not limited by those shown in the drawings, and can have any other shape, dimensions and arrangement. For example, propulsion increasing shells 24 can be twice as large as those shown in the drawings, in which case, the number of propulsion increasing shells 24 will be reduced accordingly.

Figure 5:
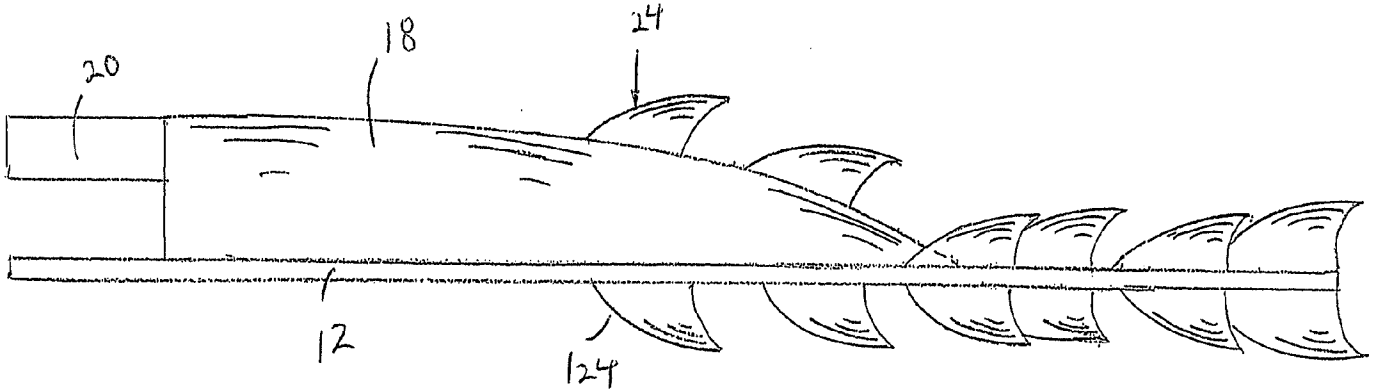
FIG. 5 is a side elevational view of a swim fin according to a second embodiment of the present invention.

As shown in FIG. 5, propulsion increasing shells 124 of the same dimensions and shape as propulsion increasing shells 24, can also be provided on the lower surface of blade 12, thereby further increasing the propulsion during a downward stroke.

Figure 6:
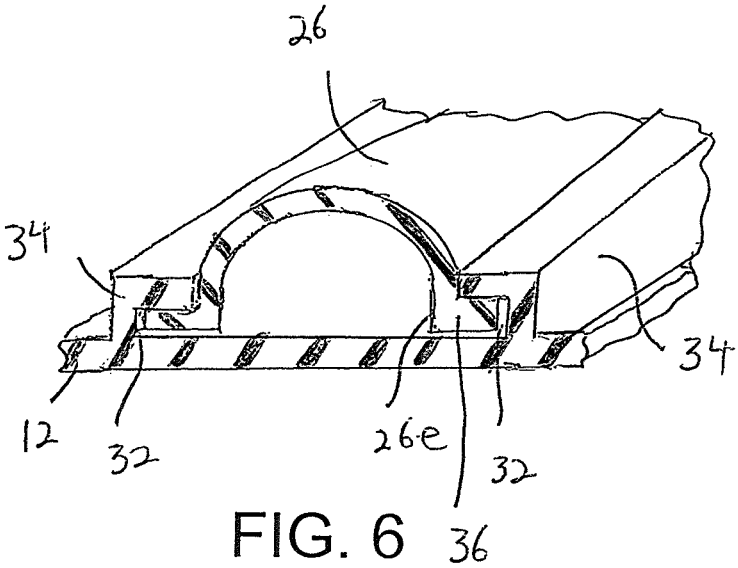
FIG. 6 is a perspective view showing an alternative construction for attaching one of the protruding shells to the blade.

Although propulsion increasing shells 24 have been shown above as being integrally formed as a unitary member with blade 12, for example, during a molding operation, it is possible to separately connect propulsion increasing shells 24 to blade 12. For example, FIG. 6 shows elongated grooves 32 formed by two inwardly directed L-shaped walls 34 extending from the upper surface of blade 12. In such case, the lower side edges 26*e* of shell membrane 26 include outwardly directed tongues 36 that fit within grooves 32. Because of the flexible and resilient nature of the material of shell membranes 26, they can be squeezed inwardly until tongues 36 fit within grooves 32, and then when released, will return to their original shape, seating tongues 36 fully in grooves 32 and capturing shell membrane 26 in such position. Of course, grooves 32 would be tapered toward each other at the rear ends thereof to correspond to the tapering shape of shell membranes 26. This embodiment has the advantage that a person can select the number and positions of propulsion increasing shells 24 to be secured to blade 12.

Figure 7:
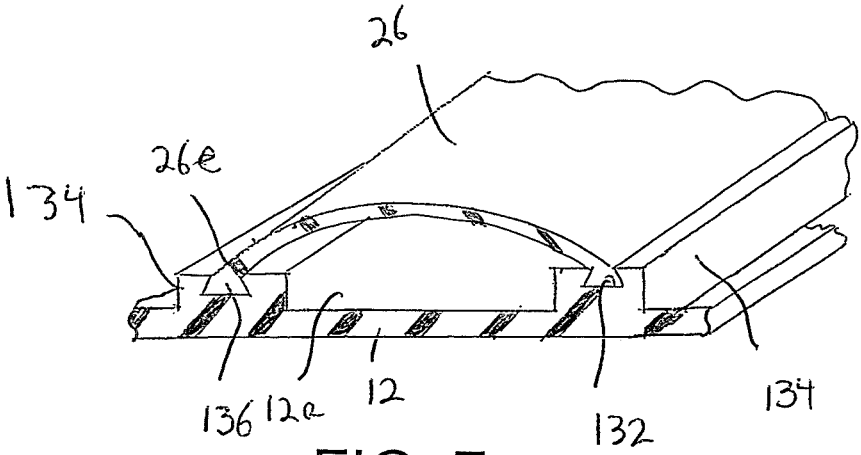
FIG. 7 is a perspective view showing a further alternative construction for attaching one of the protruding shells to the blade.

FIG. 7 shows an alternative configuration of grooves 132 formed in the upper surfaces of elongated bosses 134 extending from upper surface 12*a* of blade 12. Preferably, grooves 132 have a keystone or trapezoidal shape, although the present invention is not limited to this shape. In such case, the lower side edges 26*e* of shell membrane 26 include downwardly directed tongues 136 of the same keystone or trapezoidal shape that fit within grooves 132. In such case, tongues 136 would be slid within grooves 136 for attachment purposes.

Any other suitable securing arrangement can be used.

With the above embodiment of FIG. 5, because of the flexible and resilient nature of propulsion increasing shells 24, they will deform if provided on the lower surface 12*b* of blade 12 when a person is walking on dry land.

Figure 8:
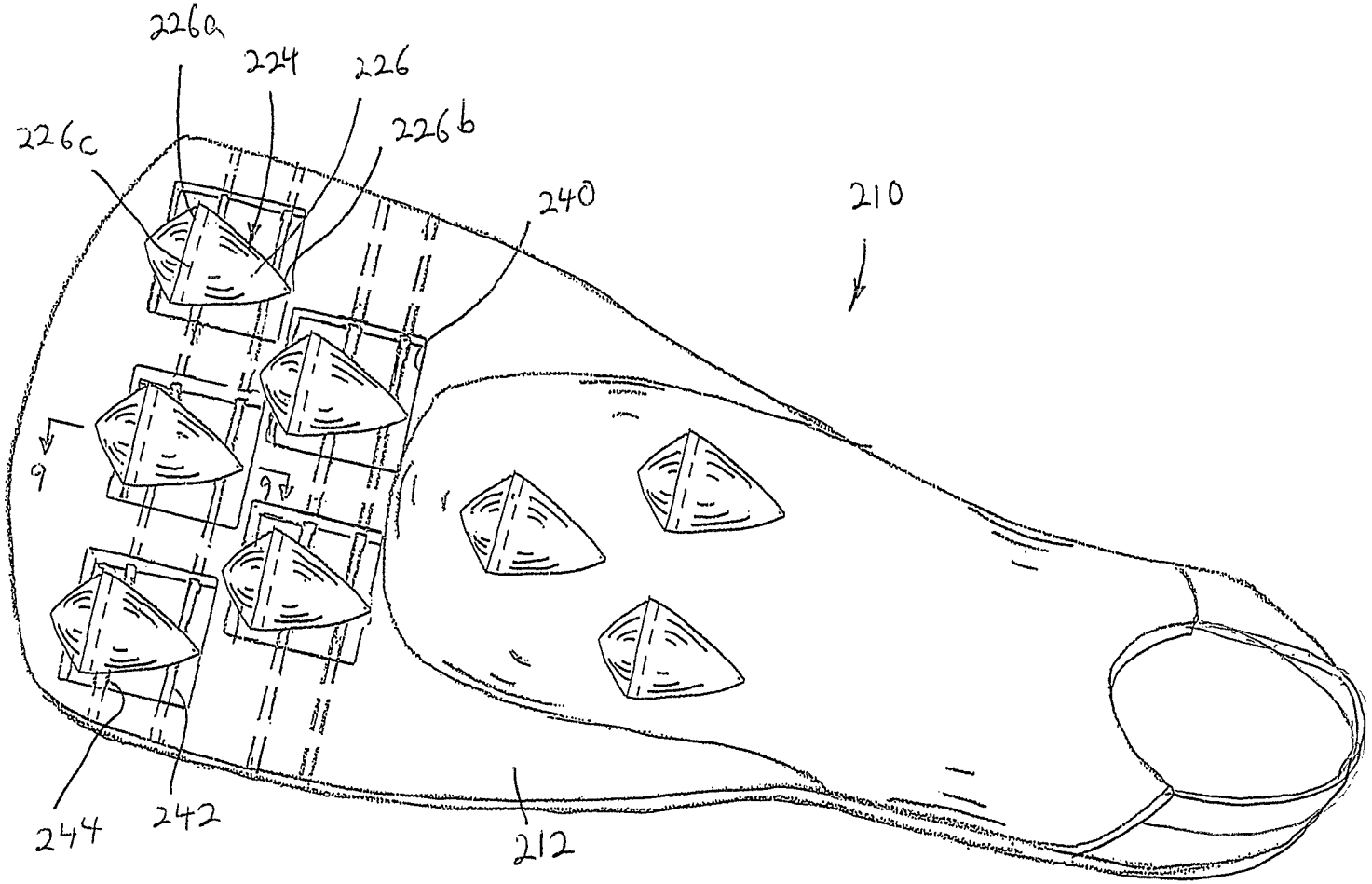
FIG. 8 is a top perspective view of a swim fin according to a third embodiment of the present invention.
Figure 9:
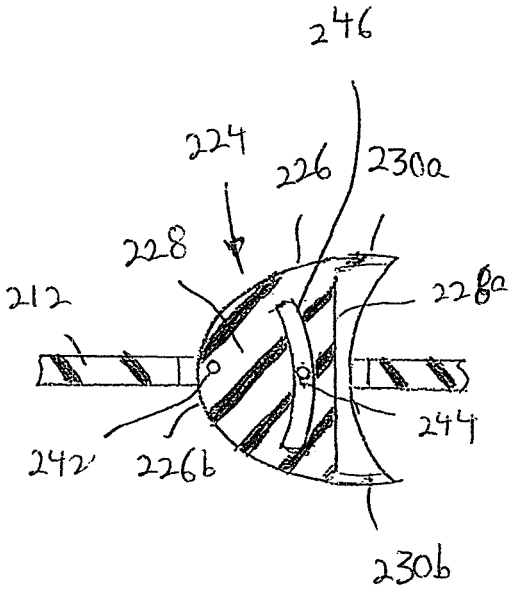
FIG. 9 is a cross-sectional view of the swim fin of FIG. 8, taken along line 9-9 thereof.

However, to better enable walking with the swim fin, reference is now made to the further embodiment of a swim fin 210 of FIGS. 8 and 9 in which propulsion increasing shells 224 are pivotally mounted to blade 212.

In this embodiment, a plurality of openings 240 are provided in blade 212 at the positions of propulsion increasing shells 224. Each propulsion increasing shell 224 is formed effectively as a combination of propulsion increasing shells 24 and 124 combined into a single propulsion increasing shell 224, as best shown in FIG. 9. Thus, each propulsion increasing shell 224 is formed with twice the height of propulsion increasing shell 24 or 124, and has a cowl or hood membrane 230*a* and 230*b* formed at the upper edge and lower edge, respectively.

Each propulsion shell 224 includes an outer arcuate shell membrane 226 that tapers in width from a forward edge 226*a* to a rear end 226*b* thereof.

The majority of shell membrane 226, starting from the rear end 226*b* thereof is filled by a solid fill 228 of the same material as shell membrane 226 and swim fin 10, that is, solid fill 228 fills that portion of shell membrane 226 that extends from rear end 226*b* to a position indicated by dashed lines 226*c* in FIG. 8. As a result, a front wall 228*a* is formed near the open forward edge 226*a* of propulsion increasing shells 224, spaced slightly rearwardly of forward edge 226*a*. This prevents too much water from entering propulsion increasing shells 224 and causing a drag on the swim fin. As with the first embodiment, solid fill 228 can be replaced merely by a front wall, with an air pocket behind the front wall for increasing buoyancy of the swim fin.

A pivot pin 242 extends across each opening 240 near the rear edge thereof, and through a rear portion of solid fill 228, thereby pivotally connecting each propulsion increasing shell 224 within a respective opening 240.

In order to limit the amount of pivoting action, a further limiting pin 244 extends across each opening 240 near a midpoint thereof, and through an arcuate slot 246 near the forward end of each solid fill 228, or at least in the side walls of the shell.

In operation, during a swimming action, when a person executes a down stroke, with the upper surface of blade 212 facing down, this upper surface functions to provide a propulsion force. During this down stroke, the force of the water forces propulsion increasing shells 224 to initially pivot in a direction towards the upwardly facing underside of blade 212 until limiting pin 244 reaches the respective end of arcuate slot 246. Then, during the remainder of the down stroke, propulsion increasing shells 224 are fixed and cannot move further, and thereby operate in the same manner previously described with propulsion increasing shells 24 of the embodiment of FIGS. 1-4.

Thus, in addition to the downwardly facing upper surface of blade 12 serving to provide propulsion, water is also displaced by cowl 230*b* at the lower edge, as well as the underside of propulsion increasing shell 224 defined by the hollow portion thereof situated in front of solid wall 228.

During a reverse stroke, the same operation occurs, but with the cowl 230*a* at the upper edge.

This embodiment has the dual advantage that a single propulsion increasing shell 224 functions for both the upward and downward strokes, as well as providing that, when a person is walking on dry land, a pivoting action will occur which will pivot propulsion increasing shells 224 upwardly through openings 240, thereby making walking easier.

Figure 10:
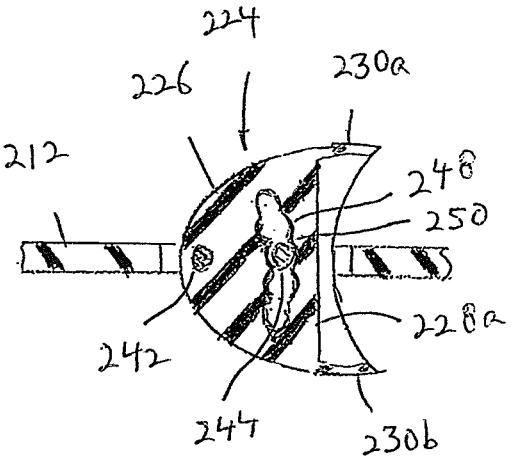
FIG. 10 is a cross-sectional view similar to FIG. 9, showing a variation thereof.

In addition, as shown in FIG. 10, it is possible to modify the embodiment of FIGS. 8 and 9, by providing arcuate slot 246 with a plurality of discrete pockets 248 defined and delimited by selected narrow wall portions 250, with limiting pin 244 having a diameter greater than the narrow wall portions 250. Because of the flexibility and resilience of the material, propulsion increasing shell 224 can be pushed up or down by a person, so that limiting pin 244 is pushed through the narrow wall portions 250 into a desired pocket 248, which holds the propulsion increasing shell 224 in that position. In this manner, a person can, for example, retain propulsion increasing shells 224 in an upwardly pivoted position at all times while walking, or can orient propulsion increasing shells 224 at a desired position during swimming.

Figures 11, 12, 13:
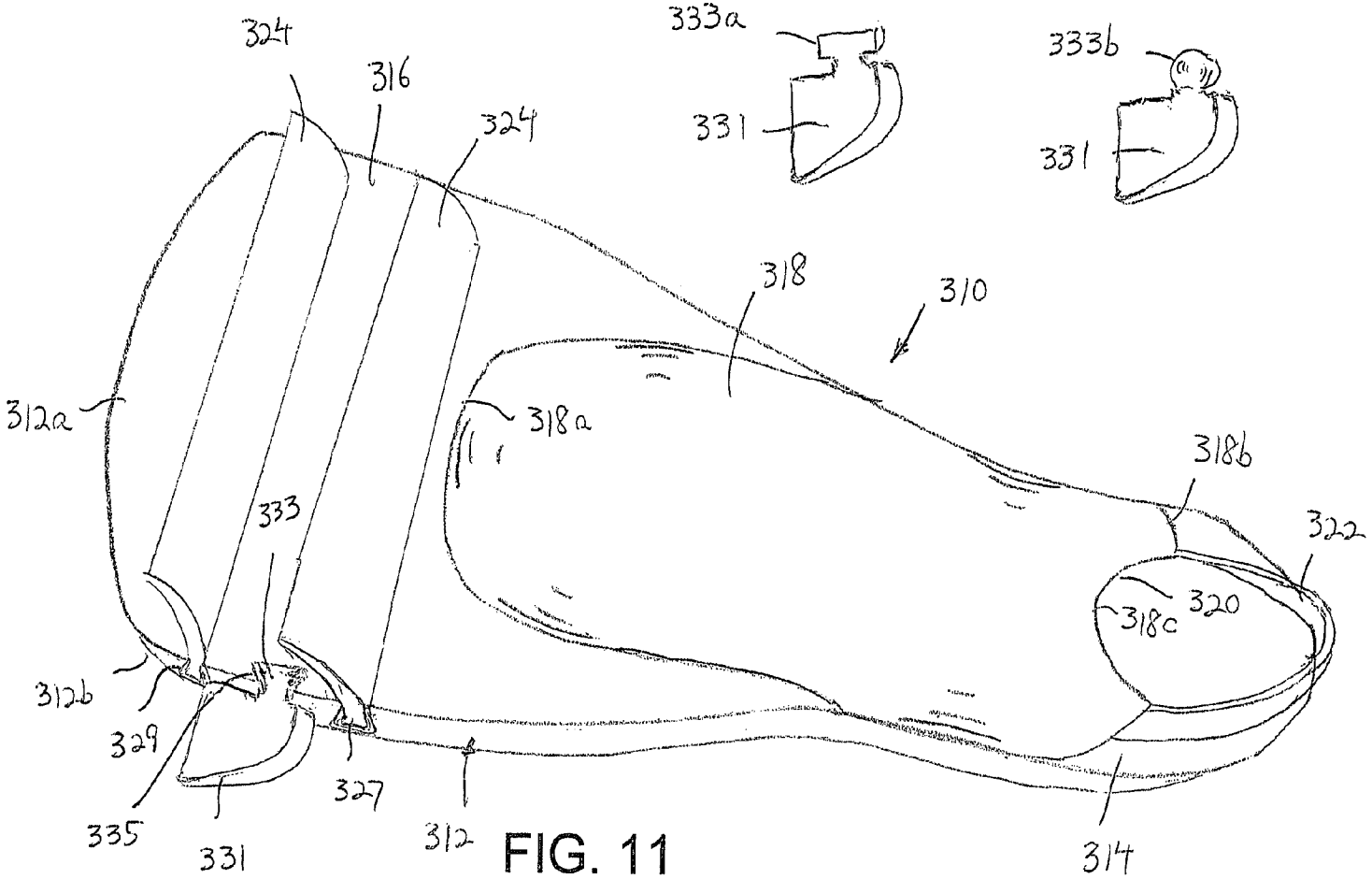
FIG. 11 is a top perspective view of a swim fin according to a fourth embodiment of the present invention.
FIG. 12 is a perspective view of a modified shell for the fourth embodiment of the present invention.
FIG. 13 is a perspective view of another modified shell for the fourth embodiment of the present invention.

Referring now to FIG. 11, there is shown a swim fin 310 according to another embodiment of the present invention.

As with swim fin 10, swim fin 310 includes a generally flat blade 312 having an upper surface 312*a* and a lower surface 312*b*. Flat blade 312 includes a foot receiving section 314 for supporting a person's foot thereon, and a diverging propulsion section 316 that is integral with and extends forwardly from foot receiving section 314. Propulsion section 316 has a greater widthwise dimension than foot receiving section 314 in order to increase the surface area, and thereby, the propulsion during a swimming stroke, as is well known. An elongated foot encasing membrane 318 extends upwardly from the upper surface 312*a* of foot receiving section 314 in a generally arcuate manner in order to define a foot receiving recess 320 between foot receiving section 3414 and foot encasing membrane 318. Foot encasing membrane 318 is connected to foot receiving section 314 at its forward end 318*a* so as to close off foot receiving recess 320 thereat, but is raised above and not connected with foot receiving section 314 at its rear edge 318*b* in order to permit entry and exit of a foot from foot receiving recess 320. In addition, rear edge 318*b* can be formed with an arcuate indent 318*c* in order to better receive the person's foot and to provide comfort to the foot when positioned in foot receiving recess 320.

An elastic strap 322 is connected to opposite sides of foot encasing membrane 318 in order to engage the heel of the person's foot and prevent escape of the foot from foot receiving recess 320 during a swimming stroke.

In accordance with the present invention, a plurality of parallel, spaced apart, curved propulsion increasing walls or blades 324 are formed on the upper surface 312*a* of propulsion section 316. Each propulsion increasing blade 324 includes an arcuate blade that is forwardly curved, and that extends upwardly from the upper surface 312*a* of propulsion section 316.

To secure each curved propulsion increasing blade 324 to propulsion section 316 of blade 312, the lower end of each propulsion increasing blade 324 is preferably provided with a tongue 327 that tightly fits within a track or groove 329 in upper surface 312*a* of propulsion section 316. In FIG. 11, tongue 327 and groove 329 are shown to have a keystone or trapezoidal cross-sectional configuration. However, the present invention is not limited to this configuration, and other configurations such as a T-shape configuration, a ball and socket configuration and the like can be used.

In addition, as shown in FIG. 11, curved propulsion increasing side blades 331 are provided which are forwardly inclined and are attached at and extend laterally outward from side edges of blade 312.

To secure each side blade 331 to side edges of blade 312, the inner end of each side blade 331 is preferably provided with a tongue 333 that tightly fits within a groove 335 at the side edge of blade 312. In FIG. 11, tongue 333 and groove 335 are shown to have a keystone or trapezoidal cross-sectional configuration. However, the present invention is not limited to this configuration, and other configurations such as a T-shape tongue 333*a* shown in FIG. 12, a ball and socket tongue 333*b* shown in FIG. 13, and the like can be used, with correspondingly shaped grooves.

As with the other embodiments, curved propulsion increasing blades 324 can be provided on lower surface 12*b* of blade 12, and the number and positioning of such blades 324 can be varied.

In addition, curved propulsion increasing blade 324 can be used in combination with propulsion increasing shells 24, 124, 224 in accordance with any of the above embodiments.

As with the other embodiments, curved propulsion increasing blades 324 and side blades 331 can be removably mounted to blade 312.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A swim fin comprising:

a blade, a retaining arrangement on the blade for removably securing a person's foot to the blade, and at least one propulsion increasing curved wall mounted to at least one surface of the blade, each propulsion increasing curved wall having a surface which increases a propulsion surface area of the swim fin for providing increased propulsion, said at least one propulsion increasing curved wall includes at least one propulsion increasing shell, wherein each shell includes:

a shell membrane extending outwardly from said at least one surface of the blade, a front wall formed inwardly of a forward edge of each shell to prevent entry of water into said shell membrane behind said front wall, and a cowl that extends outwardly from the front wall of the shell membrane, wherein an undersurface of the shell membrane in front of the front wall and an undersurface of the cowl function to provide an additional propulsion force during a swim stroke.

2. A swim fin according to claim 1, wherein the cowl forms a continuation of a front edge of the shell membrane.

3. A swim fin according to claim 1, wherein an air pocket is formed in the shell behind the front wall to aid in buoyancy of the swim fin.

4. A swim fin according to claim 1, wherein each said propulsion increasing shell tapers in a widthwise direction from a front end to a rear end thereof.

5. A swim fin according to claim 1, wherein the retaining arrangement includes:

an elongated foot encasing membrane mounted on the blade and defining a foot receiving recess between the blade and the foot encasing membrane, and an elastic strap connected with the foot encasing membrane for engaging a heel of a person's foot that is positioned in the foot receiving recess to prevent escape of the person's foot therefrom during a swimming operation.

6. A swim fin according to claim 1, wherein the at least one propulsion increasing curved wall is mounted to at least one of the following:

an upper surface of said blade, a lower surface of said blade, a side edge of said blade, a front edge of said blade, and an upper surface of the retaining arrangement.

7. A swim fin according to claim 1, wherein each said propulsion increasing curved wall is integrally formed in one-piece with said blade.

8. A swim fin according to claim 1, wherein said blade, said retaining arrangement and said at least one propulsion increasing curved wall are formed a material which is flexible and resilient.

9. A swim fin according to claim 1, wherein each said propulsion increasing curved wall is removably mounted on said blade.

10. A swim fin according to claim 1, wherein each blade includes at least one groove, and each said propulsion increasing curved wall includes a tongue that is removably mounted in at least one respective said groove.

11. A swim fin according to claim 10, wherein each said propulsion increasing shell includes tongues at lower edges thereof, for removable insertion in respective said grooves.

12. A swim fin comprising:

a blade, a retaining arrangement on the blade for removably securing a person's foot to the blade, and at least one propulsion increasing curved wall mounted to at least one surface of the blade, each propulsion increasing curved wall having a surface which increases a propulsion surface area of the swim fin for providing increased propulsion, wherein said at least one propulsion increasing curved wall includes at least one propulsion increasing shell, wherein each blade includes at least one opening, and wherein each said propulsion increasing shell is pivotally mounted to said blade in a respective said opening.

13. A swim fin according to claim 12, wherein each shell includes:

an upper shell membrane extending outwardly relative to an upper surface of the blade, a lower shell membrane extending outwardly relative to a lower surface of the blade, a front wall formed inwardly of a forward edge of each shell membrane and interconnecting said upper shell membrane with said lower shell membrane to prevent entry of water into said shell behind said front wall, and wherein an inner surface of the upper shell membrane in front of the front wall and an inner surface of the lower shell membrane in front of the front wall function to provide an additional propulsion force during a swim stroke.

14. A swim fin according to claim 13, further comprising a pivot connected to said blade and extending in each said opening near a rear edge thereof and through a rear portion of said shell membrane.

15. A swim fin according to claim 14, further comprising a pivot limiter for limiting a pivoting range of each said propulsion increasing shell.

16. A swim fin according to claim 15, wherein said pivot limiter includes:

an arcuate slot near a forward end of each shell, and a limiting pin extending across each opening near a midpoint thereof, and through said shell.

17. A swim fin according to claim 16, wherein each said arcuate slot includes a plurality of discrete pockets for retaining said limiting pin therein to hold the respective propulsion increasing shell at a desired position.

* * * * *